United States Patent [19]

Taub et al.

[11] Patent Number: 4,743,316

[45] Date of Patent: May 10, 1988

[54] RAPIDLY SOLIDIFIED ZIRCONIUM MODIFIED NICKEL ALUMINIDE OF IMPROVED STRENGTH

[75] Inventors: Alan I. Taub; Keh-Minn Chang, both of Schenectady; Shyh-Chin Huang, Latham, all of N.Y.

[73] Assignee: General Electric Company, Schenectady, N.Y.

[21] Appl. No.: 783,724

[22] Filed: Oct. 3, 1985

[51] Int. Cl.[4] ..... C22C 19/00

[52] U.S. Cl. ..... 148/429

[58] Field of Search ..... 148/429; 420/460

[56] References Cited

PUBLICATIONS

C. T. Liu & C. C. Koch, "Development of Ductile Polycrystalline $Ni_3AL$ for High-Temperature Applications", Technical Aspects of Critical Materials Use by the Steel Industry, NBSIR 83-2679-2, vol. IIB (Jun. 1983) Center for Materials Science, U.S. Dept. of Commerce, Nat'l. Bureau of Standards.

*Primary Examiner*—R. Dean

*Attorney, Agent, or Firm*—Paul E. Rochford; James C. Davis, Jr.; Paul R. Webb, II

[57] ABSTRACT

It had been found previously that tri-nickel aluminide compositions are quite sensitive to the ratio of nickel to aluminum in their ability to receive boron as a dopant. It has now been found that compositions which are relatively poor in the aluminum component can be doped more effectively with a combination of boron and zirconium. It has been found for the nickel aluminides which have lower concentrations of aluminum that the percent of zirconium and boron which can be added to the composition to effectively increase the strength of the alloys is favored by the lower aluminum ratio. The compositions which result are found to have significant strength properties not only at room temperature but at elevated temperatures based on tensile tests of the compositions.

18 Claims, 3 Drawing Sheets

RAPIDLY SOLIDIFIED ZIRCONIUM MODIFIED NICKEL ALUMINIDE OF IMPROVED STRENGTH

BACKGROUND OF THE INVENTION

The present invention relates generally to compositions having a nickel aluminide base and having improved ductility. More specifically, it relates to a rapidly solidified tri-nickel aluminide base alloy having improved ductility and strength based on doping with boron and modification with zirconium and improved stoichiometry which enhances such doping and modification.

It is known that polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and although potentially useful as a high temperature structural material, has not found extensive use in this application because of the poor properties of the materials at room temperature.

It is known that nickel aluminide has good physical properties at temperatures above 1000° F. and could be employed, for example, in jet engines as component parts for operating at higher temperatures. However, if the aluminide does not have favorable properties at room temperature and below, the part formed of this material may break when subjected to stress at the lower temperatures at which the part must be maintained prior to starting the engine and prior to operating the engine at the higher temperatures.

Alloys having a tri-nickel aluminide base are among the group of alloys known as heat-resisting alloys or superalloys. These alloys are intended for very high temperature service where relatively high stresses including tensile, thermal, vibratory and shock stresses, are encountered and where oxidation resistance is frequently required.

What has been sought in the field of superalloys is an alloy composition which displays favorable stress resistant properties not only at the elevated temperatures at which it may be used as, for example, in a jet engine but also a practical, desirable and useful set of properties at the lower temperatures to which the engine is subjected in storage and mounting and starting operations. For example, it is well known that an engine may be subjected to severe sub-freezing temperatures while standing on a landing field or runway prior to starting the engine.

Significant efforts have been made toward producing a tri-nickel aluminide and similar superalloys which may be useful over such a wide range of temperatures and which may be adapted to withstand stress to which the articles made from the material may be subjected in normal operations over a wide temperature range. For example, U.S. Pat. No. 4,478,791, assigned to the same assignee as the subject application teaches a method by which a significant measure of ductility can be imparted to a rapidly solidified tri-nickel aluminide base metal at room temperature by addition of a small percentage of boron to overcome the brittleness of this material.

Also, copending applications of the same inventors as the subject application, Ser. Nos. 647,327, 647,326, 646,877 and 647,328, respectively, filed Sept. 4, 1984 teach methods by which the composition and methods of the U.S. Pat. No. 4,478,791 may be further improved. These applications are incorporated herein by reference.

For the unmodified binary intermetallic, there are many reports in the literature of a strong dependence of strength and hardness on compositional deviations from stoichiometry. E.M. Grala in "Mechanical Properties of Intermetallic Compounds", Ed. J.H. Westbrook, John Wiley, New York (1960) p. 358, found a significant improvement in the room temperature yield and tensile strength in going from the stoichiometric compound to an aluminum-rich alloy. Using hot hardness testing on a wider range of aluminum compositions, Guard and Westbrook found that at low homologous temperatures, the hardness reached a minimum near the stoichiometric composition, while at high homologous temperature the hardness peaked at the 3:1 Ni:Al ratio. Met. Trans. 215 (1959) 807. Compression tests conducted by Lopez and Hancock confirmed these trends and also showed that the effect is much stronger for Al-rich deviations than for Ni-rich deviations from stoichiometry. Phys. Stat. Sol. A2 (1970) 469. A review by Rawlings and Staton-Bevan concluded that in comparison with Ni-rich stoichiometric deviations, Al-rich deviations increase not only the ambient temperature flow stress to a greater extent, but also that the yield stress-temperature gradient is greater. J. Mat. Sci. 10 (1975) 505. Extensive studies by Aoki and Izumi report similar trends. Phys. Stat. Sol. A32 (1975) 657 and Phys. Stat. Sol. A38 (1976) 587. Similar studies by Noguchi, Oya and Suzuki also reported similar trends. Met. Trans. 12A (1981) 1647.

More recently, an article by C. T. Liu, C. L. White, C. C. Koch and E. H. Lee appearing in the "Proceedings of the Electrochemical Society on High Temperature Materials", ed. Marvin Cubicciotti, Vol. 83-7, Electrochemical Society, Inc. (1983) p. 32, discloses that the boron induced ductilization of the same alloy system is successful only for aluminum lean $Ni_3Al$.

The subject application presents a further improvement in the nickel aluminide to which significant increased strength has been imparted by the addition of zirconium.

BRIEF SUMMARY OF THE INVENTION

It is accordingly one object of the present invention to provide a method of forming a nickel aluminide of improved ductility and strength.

Another object is to provide a rapidly solidified nickel aluminide base alloy of improved ductility and strength.

Another object is to provide a nickel aluminide alloy having high levels of doping based on a combination of boron and zirconium.

Another object is to provide a nickel aluminide having a more predictable set of properties.

Other objects will be in part apparent and in part pointed out in the description which follows.

In one of its broader aspects, objects of the present invention may be achieved by providing a rapidly solidified nickel aluminide having a nickel to aluminum ratio which is relatively poor in aluminum, i.e., the ratio of nickel to aluminum is greater than 3:1 by some margin. As explained in copending application Ser. No. 646,877 aluminum poor aluminide had previously been found to be dopable with greater concentrations of boron and to permit attainment of greater strength properties in the alloy. It has now further been found that zirconium additions can be made to aluminum poor tri-nickel aluminide to modify the aluminide. In addition, it has been found that desirable properties are obtained when the aluminum poor tri-nickel aluminide is doped with a high concentration of boron and simultaneously modified with zirconium.

Although the melt referred to above should ideally consist only of the atoms of the intermetallized phase and atoms of carbon and boron, it is recognized that occasionally and inevitably other atoms of one or more incidental impurity atoms may be present in the melt.

As used herein the expression tri-nickel aluminide base composition refers to a tri-nickel aluminide which contains impurities which are conventionally found in nickel aluminide compositions. It includes as well other constituents and/or substituents which do not detract from the unique set of favorable properties which are achieved through practice of the present invention.

BRIEF DESCRIPTION OF THE DRAWINGS

The invention will be made clearer by reference to the accompanying drawing in which.

DETAILED DESCRIPTION OF THE INVENTION

Figure 1:
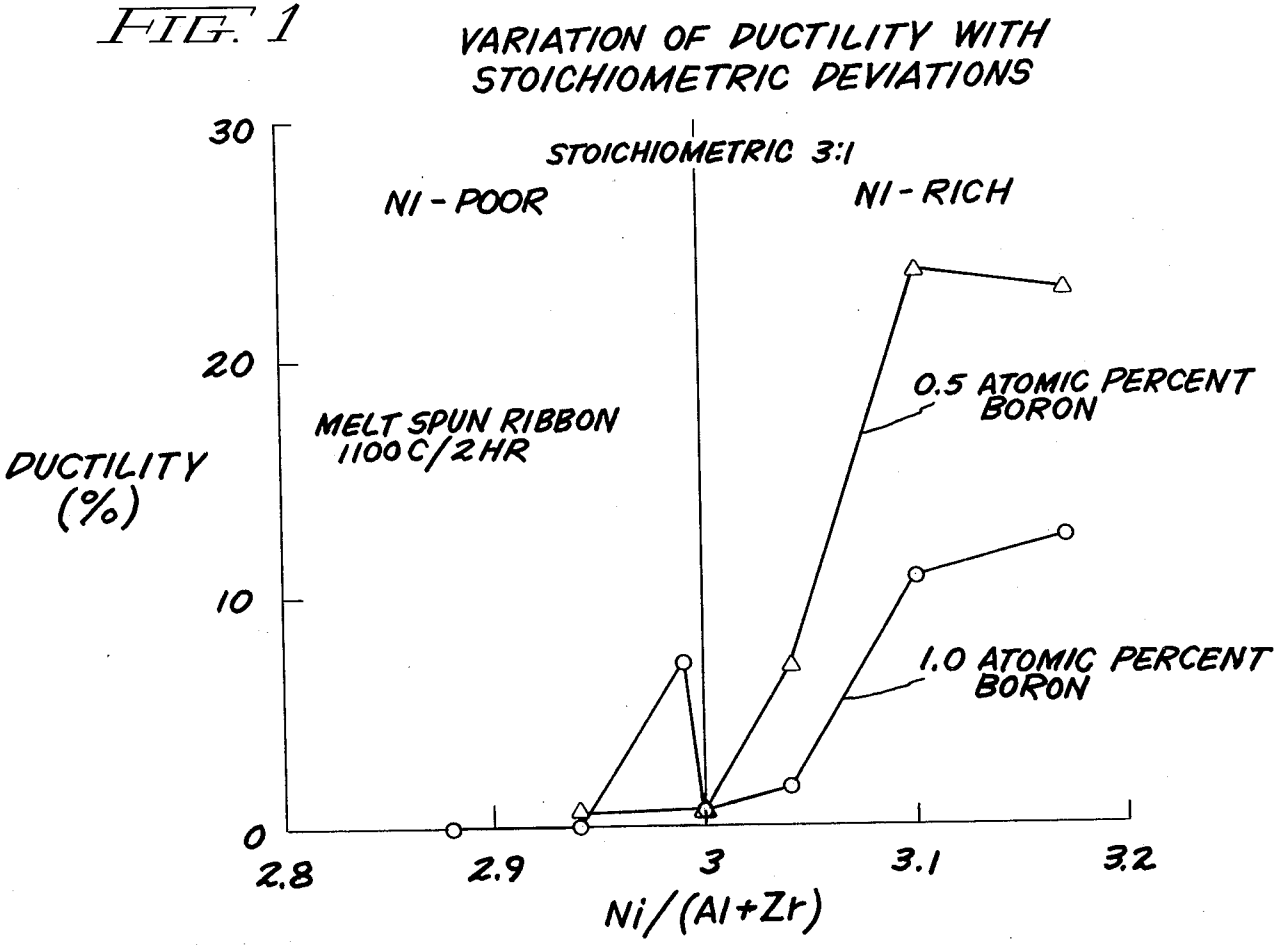
FIG. 1 is a graph of the tensile ductility in percent as the ordinate against the ratio of the nickel concentration in atomic percent to the concentration of aluminum plus zirconium in atomic percent as the abscissa. The data are for melt spun ribbons that have been annealed at 1100° C. for 2 hours. The boron doping levels are indicated.

The ductilization of $Ni_3Al$ by doping with boron and rapid solidification is discussed in copending application Ser. No. 646,877 referred to above. The text of that application is incorporated herein by reference.

In that application, it is pointed out that the ratio of nickel to aluminum in a rapidly solidified tri-nickel aluminide alloy plays a strong role in the ability of the aluminide to receive boron as a dopant and of the boron to ductilize the tri-nickel aluminide alloy. A number of compositions containing different ratios of nickel to aluminum are described particularly a number in the concentration range close to the stoichiometric 3 to 1 ratio in which the aluminum concentration is about 24 atomic %.

The stoichiometric ratio is considered only with respect to the nickel and aluminum components and not with respect to the boron or other ingredients. Thus, the stoichiometry considered in the prior application was according to the formula $$(Ni_{1-x}Al_x)_yB_{100-y}$$

where x is the aluminum concentration in the range 0.225 to 0.26, and where y is approximately 97 to 99.75.

EXAMPLE 1

A heat of composition corresponding to about 3 atomic parts nickel to 1 atomic part aluminum was prepared, comminuted, and about 60 grams of the pieces were delivered into an alumina crucible of a chill-block melt spinning apparatus. The crucible terminated in a flat-bottomed exit section having a slot 0.25 (6.35 mm) inches by 25 mils (0.635 mm) therethrough. A chill block, in the form of a wheel having faces 10 inches (25.4 cm) in diameter with a thickness (rim) of 1.5 inches (3.8 cm), made of H-12 tool steel, was oriented vertically so that the rim surface could be used as the casting (chill) surface when the wheel was rotated about a horizontal axis passing through the centers of and perpendicular to the wheel faces. The crucible was placed in a vertically up orientation and brought to within about 1.2 to 1.6 mils (30–40μm) of the casting surface with the 0.25 inch length dimension of the slot oriented perpendicular to the direction of rotation of the wheel.

The wheel was rotated at 1200 rpm, the melt was heated to between about 1350° and 1450° C. and ejected as a rectangular stream onto the rotating chill surface under the pressure of argon at about 1.5 psi to produce a long ribbon which measured from about 40–70 micrometers (μm) in thickness by about 0.25 inches in width.

EXAMPLES 2–13

A first series of alloys (2–8) was prepared and cast into ribbons as described in Example 1. These alloys had a boron doping level of 1.0 atomic percent boron. The individual alloys are listed in Table I together with a listing of the differing ratios of nickel concentration to the combined aluminum plus zirconium concentrations: i.e., Ni/(Al+Zr). The properties of the alloys as determined from tensile testing are also listed in Table I.

TABLE I

Effect of Zirconium and Aluminum Concentration on the Tensile Properties of Nickel—Aluminide Doped with 1.0 At. Pct. Boron

| Example | Melt Spinning ID | Al (at pct) | Zr (at pct) | Ni/(Al + Zr) | Heat Treat | YS (ksi) | UTS (ksi) | e (%) |
|---|---|---|---|---|---|---|---|---|
| 2 | X080983-1 | 23.76 | — | 3.17 | None | 104 | 153 | 20.1 |
| | | | | | 1100° C./2 Hr | 61 | 94 | 12.4 |
| 3 | X050884-1 | 23.64 | 0.5 | 3.10 | None | 116 | 145 | 10.5 |
| | | | | | 1100° C./2 Hr | 77 | 106 | 10.8 |
| 4 | X051184-1 | 23.52 | 1.0 | 3.04 | None | 143 | 145 | 2.0 |
| | | | | | 1100° C./2 Hr | 92 | 102 | 1.7 |
| 5 | X101182-1 | 24.75 | — | 3.00 | None | 96 | 140 | 10.5 |
| | | | | | 1100° C./2 Hr | 58 | 62 | 0.9 |
| 6 | X101483-1 | 24.70 | 0.10 | 2.99 | None | 107 | 145 | 10.0 |
| | | | | | 1100° C./2 Hr | 70 | 89 | 7.2 |
| 7 | X101283-1 | 24.60 | 0.50 | 2.94 | None | * | 186 | 0. |
| | | | | | 1100° C./2 Hr | — | — | 0. |
| 8 | X092283-1 | 24.50 | 1.00 | 2.88 | None | 188 | 196 | 1.7 ± 0.2 |

TABLE I-continued

| Effect of Zirconium and Aluminum Concentration on the Tensile Properties of Nickel—Aluminide Doped with 1.0 At. Pct. Boron | | | | | | | | |
|---|---|---|---|---|---|---|---|---|
| Example | Melt Spinning ID | Al (at pct) | Zr (at pct) | Ni/(Al + Zr) | Heat Treat | YS (ksi) | UTS (ksi) | e (%) |
| | | | | | 1100° C./2 Hr | * | 90 | 0. |

*Failed During Elastic Loading

A second series of alloys (9–13) was prepared and cast into ribbons as described in Example 1. These alloys having a boron doping level of 0.5 atomic percent boron. These alloys are listed in Table II together with a listing of the differing ratios of nickel concentration to the combined aluminum plus zirconium concentrations: i.e., Ni/(Al+Zr).

The properties of the alloys as determined from tensile testing are also listed.

TABLE II

| Effect of Zirconium and Aluminum Concentration on the Tensile Properties of Nickel—Aluminide Doped with 0.5 At. Pct. Boron | | | | | | | | |
|---|---|---|---|---|---|---|---|---|
| Example | Melt Spinning ID | Al (at pct) | Zr (at pct) | Ni/(Al + Zr) | Treat Heat | YS (ksi) | UTS (ksi) | e (%) |
| 9 | X080883-2 | 23.88 | — | 3.17 | None | 91 | 113 | 9.5 |
| | | | | | 1100° C./2 Hr | 38 | 100 | 22.9 |
| 10 | X050184-1 | 23.76 | 0.5 | 3.10 | None | 98 | 145 | 13.3 |
| | | | | | 1100° C./2 Hr | 52 | 120 | 23.7 |
| 11 | X042784-1 | 23.64 | 1.0 | 3.04 | None | 126 | 131 | 2.3 |
| | | | | | 1100° C./2 Hr | 67 | 86 | 7.0 |
| 12 | X081782-2** | 24.87 | — | 3.00 | None | 106 | 111 | 0.6 ± 0.3 |
| | | | | | 1100° C./2 Hr | 62 | 63 | 0.8 |
| 13 | X111382-1 | 24.75 | 0.5 | 2.94 | None | 125 | 128 | 0.6 |
| | | | | | 1100° C./2 Hr | 78 | 78 | 0.3 ± 0.4 |

**Chemical analysis measured the boron to be 0.7 atomic percent.

The tensile ductility data for the alloy examples 2–13 tested in the annealed condition are plotted graphically in FIG. 1.

FIG. 1 is a graph of the tensile ductility in percent as the ordinate against the ratio of the nickel concentration in atomic percent to the concentration of aluminum plus zirconium in atomic percent as the abscissa. The data are for melt spun ribbons that have been annealed at 1100° C. for 2 hours. The boron doping levels are indicated. It is evident from the data plotted in FIG. 1 that the boron induced ductilization of the alloy is most effective when the ratio of the nickel concentration to the combined aluminum plus zirconium concentration is greater than the stoichiometric 3:1.

As is evident from the data listed in Tables I and II, a significant increase in yield strength is observed for those samples to which zirconium has been added. This effect is made clearer from the data shown in FIG. 2.

Figure 2:
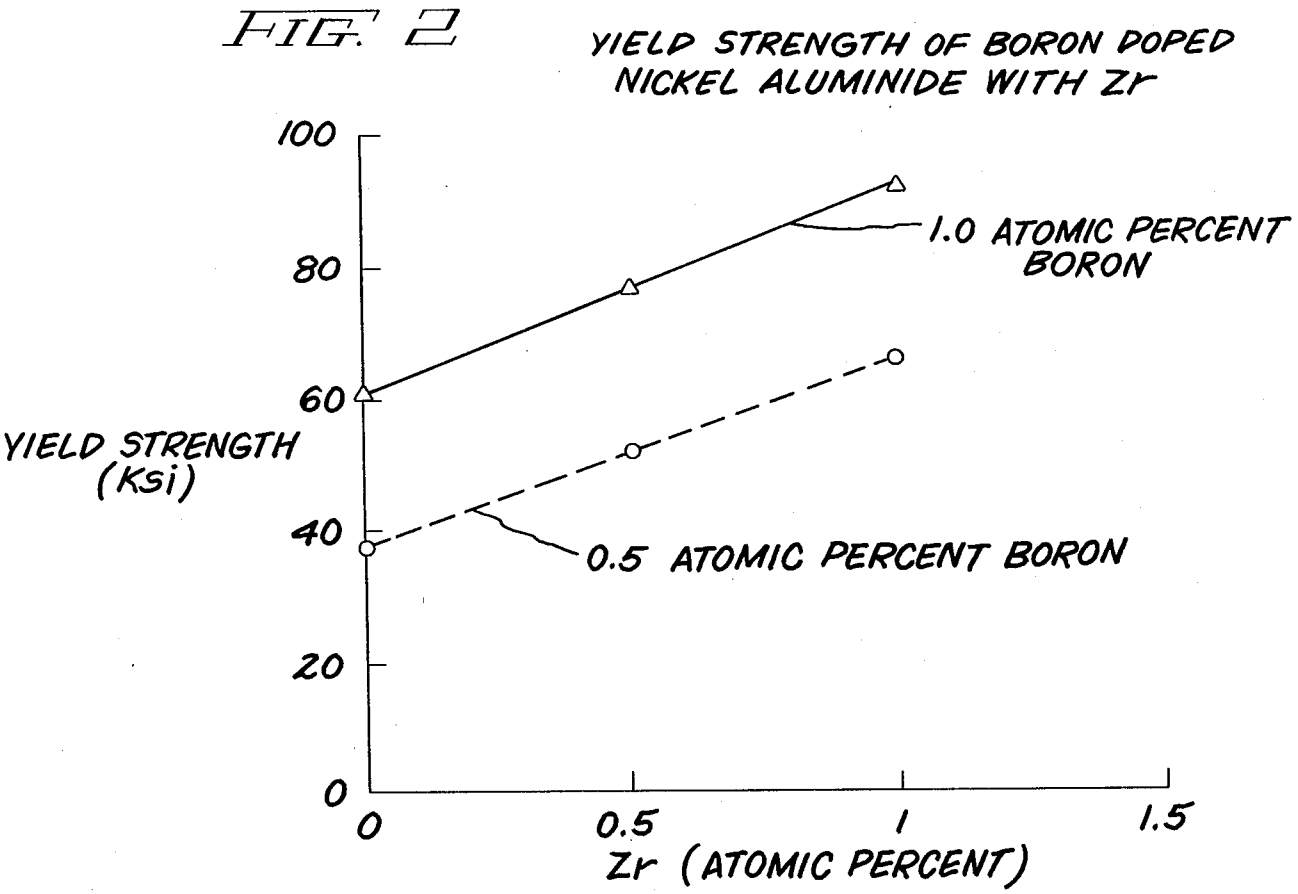
FIG. 2 is a graph of the tensile yield strength in ksi as a function of zirconium concentration in atomic percent. The data for two different boron doping levels are shown.

FIG. 2 is a graph of the tensile yield strength in ksi as a function of zirconium concentration in atomic percent. The data is for samples with stoichiometric ratio limited to 3.1±0.07 to lessen the effect of stoichiometric deviations on strength. The data for two different boron doping levels are shown. The data plotted in FIG. 2 evidences the beneficial influence of zirconium as a strengthening agent.

The data evidences that the strengthening potency of zirconium is high. The degree of this potency is indicated by the following expression:

$$dys/dc \cong 30 \text{ ksi/atomic percent.}$$

The data in Tables I and II of this application evidences that zirconium compares very favorably with boron as a strengthening agent. The data of the examples of this application evidences that the strengthening potency of zirconium is about one half of that of boron.

Figure 3:
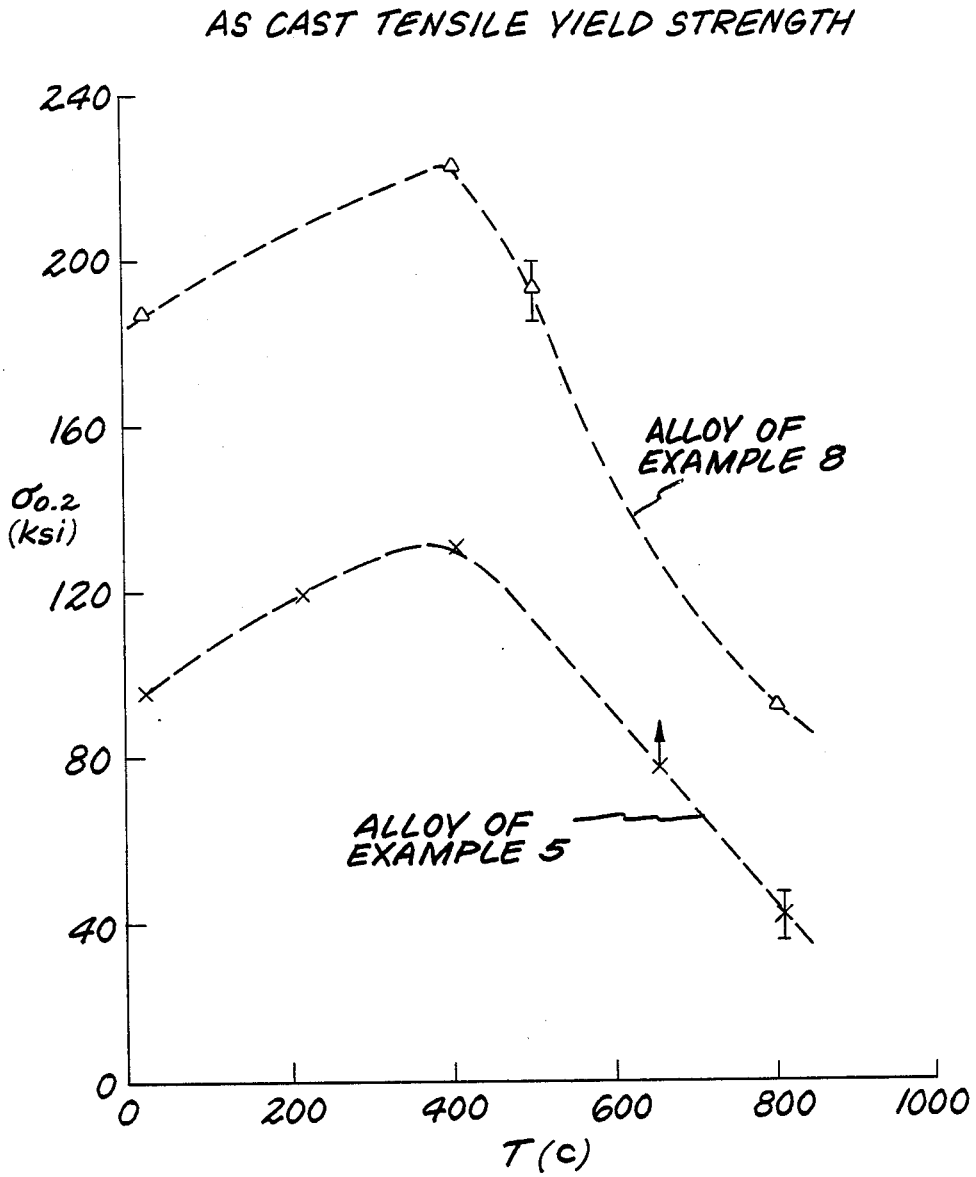
FIG. 3 is a graph of the as-cast tensile yield strength in ksi, plotted as the ordinate, against the temperature, T in degrees centigrade, plotted as the abscissa.

FIG. 3 is a graph of the as-cast tensile yield strength in ksi, plotted as the ordinate, against the temperature, T in degrees centigrade, plotted as the abscissa.

Elevated temperature tensile yield strength data is given in FIG. 3 for the nickel aluminide with and without zirconium additions. The data shown are for the alloys of Examples 8 and 5, respectively. The data plotted in this graph illustrated that the dramatic increase in yield strength is evidenced not only at room temperature but that the increased strength is retained at elevated temperatures as well.

EXAMPLE 14

An alloy was prepared and cast into ribbon as described in Example 1. The composition of the alloy was according to the following expression:

$$(Ni_{0.76}Al_{0.22}Zr_{0.02})_{99.75}B_{0.25}.$$

The alloy exhibited a yield strength of 67 ksi and a ductility of 8.7% after annealing at 1100° C. for 2 hours. This demonstrates that ductile alloys can be fabricated from compositions having zirconium concentrations as high as 2%.

What is claimed and sought to be protected by Letters Patent of the United States is as follows:

1. A nickel aluminide of improved strength comprising a rapidly solidified zirconium modified nickel aluminide having an L12 type crystal structure and having a composition according to the formula:

$$(Ni_{1-x}Al_{x-y}Zr_y)_{100-z}B_z$$

wherein x is less than 0.25, y is less than 0.025 and wherein the boron concentration, z, is between 0.10 and 2.0.

2. The composition of claim 1 in which the aluminum concentration plus the zirconium concentration, x, is between approximately 0.23 and 0.245.

3. The composition of claim 1 in which the aluminum concentration plus the zirconium concentration, x, is approximately 0.24.

4. The composition of claim 1 in which the zirconium concentration, y, is between 0.002 and 0.02.

5. The composition of claim 1 in which the zirconium concentration, y, is between 0.005 and 0.01.

6. The composition of claim 1 in which the boron concentration, z, is between 0.1 and 1.5 atomic percent.

7. The composition of claim 1 in which the aluminum concentration plus the zirconium concentration, x, is between about 0.23 and about 0.245 and wherein the atomic percent boron, z, is between 0.10 and 1.5.

8. The composition of claim 1 in which the zirconium concentration plus the aluminum concentration, x, is between 0.23 and about 0.245 and wherein the atomic percent zirconium, y, is between 0.005 and 0.01.

9. The composition of claim 1 in which the zirconium concentration plus the aluminum concentration, x, is about 0.24 and the zirconium concentration, y, is between 0.005 and 0.01.

10. The composition of claim 1 in which the zirconium concentration plus the aluminum concentration, x, is about 0.24, the boron concentration, z, is about 1.0 and the zirconium concentration, y, is about 0.01.

11. The method of forming an L12 type nickel aluminide of improved strength which comprises preparing a melt of the following composition:

$$(Ni_{1-x}Al_{x-y}ZR_y)_{100-z}B_z$$

adjusting x to less than 0.25, y is less than 0.025 and adjusting the boron concentration, z, to between 0.10 and 2.0, and rapidly solidifying the melt.

12. The method of claim 11 in which the aluminum concentration plus the zirconium concentration, x is set between approximately 0.23 and 0.245.

13. The method of claim 11 in which the aluminum concentration plus the zirconium concentration, x, is set at approximately 0.24.

14. The method of claim 11 in which the boron concentration, z, is set between 0.10 and 1.5 atomic percent.

15. The method of claim 11 in which the aluminum concentration plus the zirconium concentration, x, is set between about 0.23 and about 0.245 and wherein the atomic percent boron, z, is set between 0.10 and 1.5.

16. The method of claim 11 in which the aluminum concentration, x-y, is set between 0.23 and about 0.245 and wherein the atomic percent zirconium, y, is set between 0.002 and 0.02.

17. The method of claim 11 in which the aluminum concentration, x-y, is set at about 0.24 and the zirconium concentration, y, is set between 0.005 and 0.01.

18. The method of claim 11 in which the aluminum concentration, x-y, is set at about 0.24, the boron concentration, z, is set at about 1.0 and the zirconium concentration, y, is set at about 0.01.

* * * * *